United States Patent [19]

Thomas

[11] Patent Number: 4,480,762

[45] Date of Patent: Nov. 6, 1984

[54] REUSEABLE VIAL CAP

[75] Inventor: Michael D. Thomas, Arab, Ala.

[73] Assignee: Ryder International Corporation, Arab, Ala.

[21] Appl. No.: 387,345

[22] Filed: Jun. 11, 1982

[51] Int. Cl.[3] ..... B65D 45/00

[52] U.S. Cl. ..... 215/273; 215/216; 215/280

[58] Field of Search ..... 215/216, 273, 280, 317, 215/329

[56] References Cited

U.S. PATENT DOCUMENTS

| | | | |
|---|---|---|---|
| 622,074 | 3/1899 | Reeder | 215/273 |
| 706,771 | 8/1902 | McCrosky | 215/280 |
| 3,642,161 | 2/1972 | Stroud | 215/216 |
| 3,703,975 | 11/1972 | Wittemer | 215/216 |
| 3,997,077 | 12/1976 | Mill et al. | 215/329 |

*Primary Examiner*—Joseph Man-Fu Moy
*Assistant Examiner*—David Fidei
*Attorney, Agent, or Firm*—Trexler, Bushnell & Wolters, Ltd.

[57] ABSTRACT

A reuseable plastic cap is disposed over a seal closure on a vial neck to retain the seal closure in place thereon, the cap comprising a body of resilient material having a base overlying the seal closure, opposed jaws on the base for gripping a bead on the vial neck, gripper flanges for manual engagement to spread apart the jaws so as to install or remove the cap on the vial neck, and a releasable locking bar to hold the gripper flanges spread apart and thereby retain the jaws in a locked condition on the vial neck.

2 Claims, 13 Drawing Figures

REUSEABLE VIAL CAP

BACKGROUND OF THE INVENTION

This invention relates generally to improvements in container closures, and more particularly to a reuseable cap for disposition over a seal closure on a vial neck to retain the seal closure in place.

It is a common practice for opthomologists and optometrists that are engaged in the practice of fitting soft contact lenses to utilize, in connection with lens fitting procedures, a tray that contains a number of vials having test or examination lenses. The vials are marked in accordance with the optical characteristics of the contact lens therein contained. Each vial also contains a disinfecting solution and a seal closure over the vial neck. The seal closure is usually retained by a soft aluminum cap which is crimped onto the vial neck over the seal closure.

In fitting the patient for lenses the opthmologist or optometrist will utilize a number of these test lenses by applying them to the patient's eyes selectively until the correct prescription is ascertained. The used test lenses are returned to the vials from which they were taken, following which the used test lenses must be disinfected.

In carrying out the disinfecting procedure a suitable disinfecting solution is introduced into the vials and a seal closure is placed on each vial neck. The aluminum caps are then crimped onto the vial necks over the seal closures by a suitable tool, whereupon the vials heated to bring the solution to the disinfecting temperature for the requisite time to disinfect the lenses therein. The crimped cap serves to retain the seal closure onto the vial neck and thereby prevent the seal closure from blowing off of the vial neck as a result of pressures created within the vial during the disinfecting procedure. Normally the opthomologist or optometrist maintains a supply of these aluminum caps because it is necessary to reseal a number of vials after each examination. Because the crimped cap is torn away each time the vial is opened for access to the lens therein, the crimped cap is suitable for one-time use only with the result that the utilization of crimped caps becomes wasteful.

It has also been proposed to use threaded caps but this has not been found to be practical because the vials, which are generally of standard construction, do not include a threaded neck. Moreover, it is expensive to produce a non-standard vial with a thread on its neck and a companion threaded cap.

OBJECTS AND SUMMARY OF THE INVENTION

An object of this invention is to provide a reuseable cap which takes the place of the crimped aluminum cap in retaining the seal closure over the vial neck.

It is a further object of this invention to provide a reuseable cap of the type stated which can be applied to a type of vial and seal closure which is in widespread use.

Another object of this invention is to provide a reuseable cap of the type stated which does not require the use of expensive molds to make a threaded cap or threaded vial neck. Furthermore, a supply of aluminum caps and the crimping tool for applying the caps to the vial necks are not required.

A further object of the invention is to provide a reuseable cap which can be applied to or removed from the vial neck without the use of tools and which is formed of a resilient molded plastic material, resulting in a cap of relatively inexpensive construction.

In accordance with the foregoing objects and advantages of the invention the reuseable cap is disposed over a seal closure on a vial neck to retain the seal closure in place and wherein said neck has inner and outer axial ends and with one part of said seal closure being across said outer axial end and another part of said seal closure being along the interior of said neck and extending from said one part toward said inner axial end; said cap comprising a body of resilient material having a base for overlying said one seal closure part, opposed jaws on said base and projecting in one direction therefrom and adapted to extend toward said inner axial end in radially outwardly overlying relation to the other seal closure part, opposed gripper flanges on said base and projecting in a direction opposite to said one direction and adapted to be manually gripped and pushed toward each other to flex said base and spread said jaws apart in opposition to the spring forces in the flexed base tending to bias said jaws toward each other, and locking means carried by said body and movable to and from an unlocked position in which said gripper flanges are movable toward each other to spread said jaws to a locked position in which said gripper flanges are restrained by said locking means from moving toward each other.

DETAILED DESCRIPTION

Figure 1:
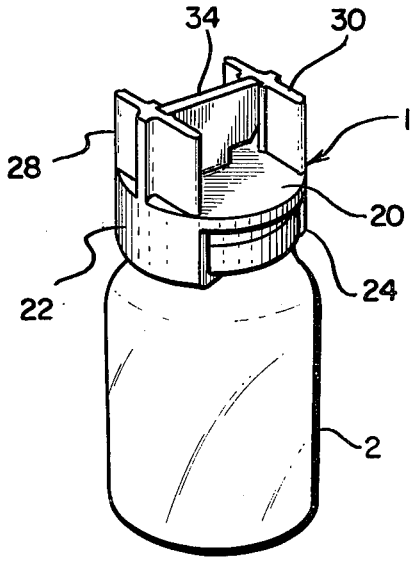
FIG. 1 is a perspective view of a vial having mounted thereon a reuseable cap constructed in accordance with and embodying the present invention.

Referring now in more detail to the drawing there is shown a vial 2 having a cylindrical neck 4 with an inner or lower axial end 6, and an upper or outer axial end 8 at which there is an annular radially outwardly projecting bead 10. A rubber-like seal closure 12 is disposed across the neck 4. This seal closure 12 is in the form of a stopper in which one part 14 namely the head of the seal closure is across the outer axial end 8 of the neck and another part 16 namely the shank of the seal closure fits snugly within the neck and extends from the head part 14 toward the inner axial end 6.

The reuseable cap 1 comprises a one-piece plastic body 18 of molded resilient plastic material and having a flat circular base 20. The base 20 has a diameter slightly greater than the outer diameter of the seal closure part 14 and is adapted to fit flush thereagainst. Depending from the base 20 at its periphery are arcuate jaws 22, 24 each having a radially inwardly projecting lip or flange 26, 26 which underlies the bead 10. The arcuate extent of each jaw 22, 24 may be of the order of 90° and the jaws are diametrically opposed. Preferably the axial distance between the flanges 26 and the underside of the base 20 is slightly less than or equal to the combined thickness of the bead 10 and the seal closure part 14. Thus, when the reuseable cap is in mounted position on the vial neck 6, the jaws 22, 24 will embrace the closure part 14 and the bead 10 and the flanges 26 will retain the cap 1 snugly on the vial neck 6.

Projecting upwardly from the base 20 adjacent to its periphery and in the region of the jaws 22, 24 are opposed gripper flanges 28, 30 which are generally flat and parallel. Each flange 28, 30 includes a vertical central stiffening rib 32. Between the gripper flanges 28, 30 is a locking bar member 34 which is attached to the upper side of the base 20 along a line defined by an integral or "live" hinge 36 which runs perpendicular to the gripper flanges 28, 30. The hinge 36 enables the locking bar 34 to be moved to and from the full line and broken line positions shown in FIGS. 6 and 7, which positions are approximately 90° apart. The locking bar includes a somewhat narrow section 38 the margin of which is at the hinge 36, and a wider section 40 above the narrower section 38. The wider section 40 is cutaway at its sides facing the gripper flanges 28, 30 to form clearances 42, 42, for purposes presently more fully appearing.

Figure 2:
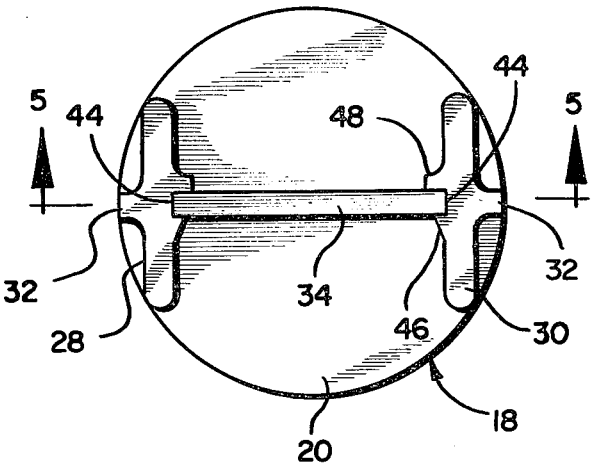
FIG. 2 is an enlarged top plan view of the structure of FIG. 1.
Figure 3:
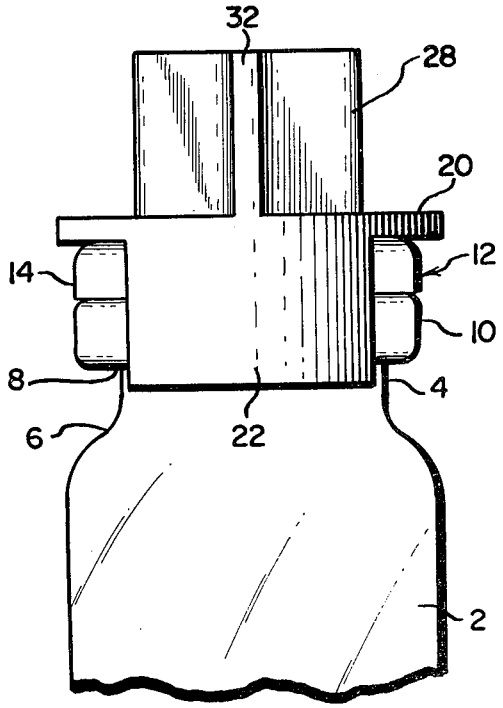
FIG. 3 is an elevational view of the upper end of the vial and showing the reuseable cap thereon.
Figure 4:
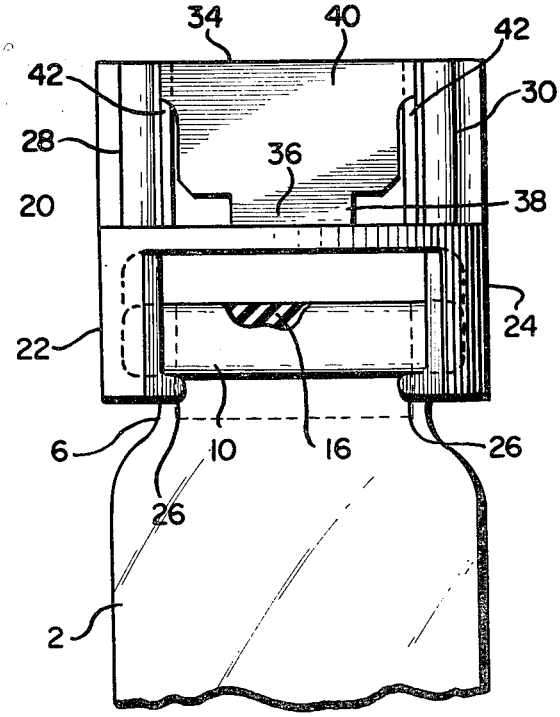
FIG. 4 is another elevational view similar to FIG. 3 but rotated 90° therefrom and being partially broken away and in section.
Figure 5:
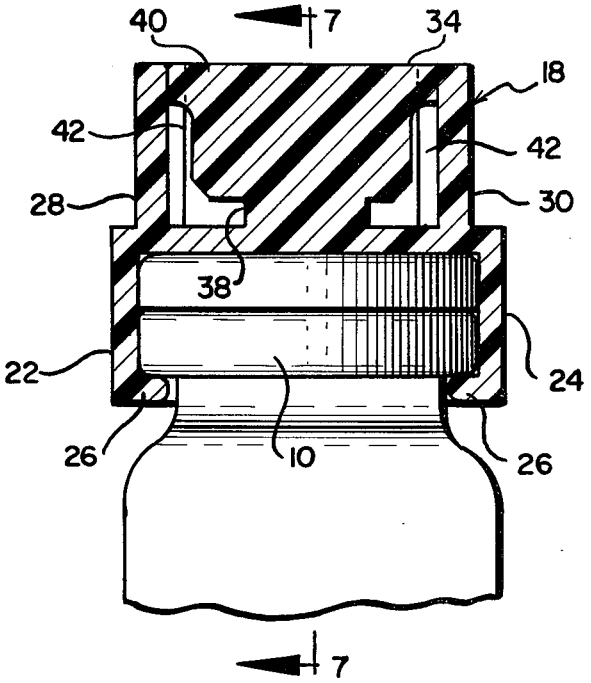
FIG. 5 is a sectional view taken along line 5—5 of FIG. 2.
Figure 8:
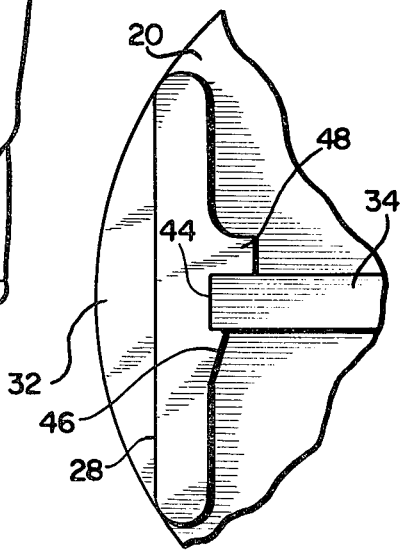
FIG. 8 is an enlarged top view of a portion of FIG. 2 and showing the means for retaining the locking bar in its locked position.

Furthermore, the gripper flanges 28, 30 each have a radially inwardly presented notch 44 best shown in FIGS. 2 and 8. The notch 44 is defined by a ramp 46 and an adjacent stop shoulder 48.

Figure 7:
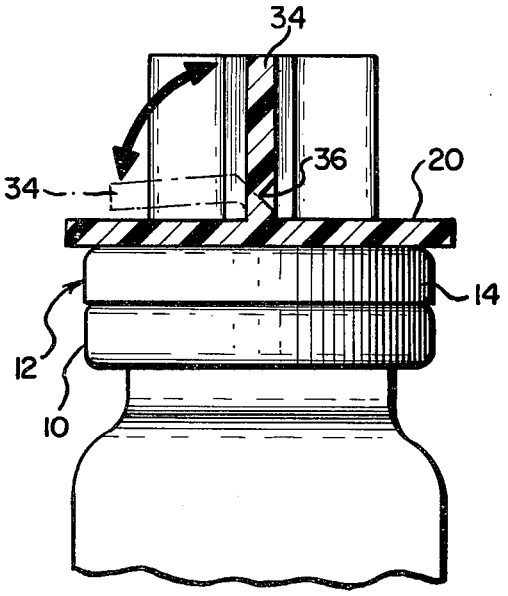
FIG. 7 is a sectional view taken along line 7—7 of FIG. 5.
Figure 6:
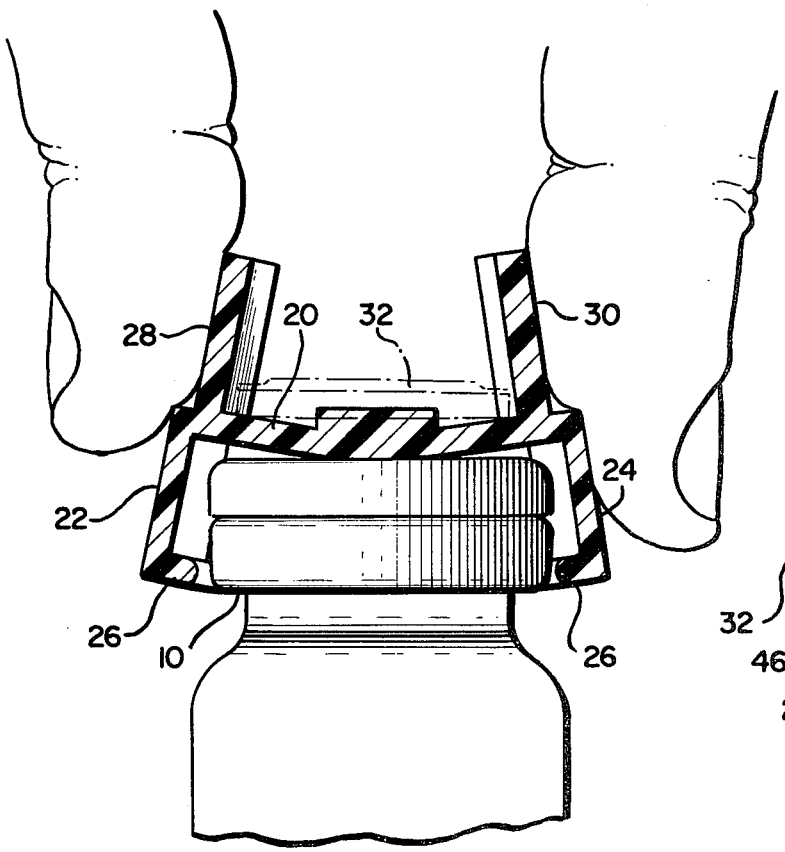
FIG. 6 is a sectional view similar to FIG. 5 but showing the jaws spread apart to enable the cap to be placed on or removed from the vial neck.

When it is desired to apply the reuseable cap to the vial neck the locking bar 34 is shifted to its unlocked position, namely the position shown in broken lines in FIGS. 6 and 7. The opposed gripper flanges 28, 30 are then grasped between the thumb and forefinger of the user, as shown in FIG. 6, and are pushed together to spread the jaws 22, 24 apart an amount sufficient so that the flanges 26, 26 clear the bead 10 and the seal closure part 14. The clearances 42 provide spaced into which the gripper flanges 28, 30 can move so that the locking bar 34 in its unlocked position does not impede movement of the gripper flanges and consequent spreading of the jaws 22, 24. Upon release of the gripper flanges the resiliency of the base 20, which is flexed within its elastic limits, urges the jaws 22, 24 toward each other and the base 20 assumes its normal substantially flat condition when the jaws are at their normal positions shown in FIGS. 1–5.

When it is desired to mount the reuseable cap onto the vial neck the jaws 22, 24 are spread apart in the manner just described and the cap is placed over the vial neck so that the base 20 seats against the upper surface of the seal closure part 14. Upon release of the gripper flanges 28, 30 the jaws 22, 24 will move toward their closed positions in which the flanges 36, 36 underlie the bead 10. To lock the jaws in place and thereby maintain the seal closure snugly on the vial neck the locking bar 34 is shifted from the broken line positions shown in FIGS. 6 and 7 to the full line positions shown in FIGS. 1–5, 7 and 8. Upon such movement the locking bar 34 will swing upwardly and its opposed edges adjacent to its free end will engage the ramps 46. The locking bar 34 will yield within its elastic limits as it is pressed toward and rides over the ramps 46 and then snaps into the notches 44, 44. This retains the gripper flanges 28, 30 apart and hence the jaws 22, 24 stay in a locked position. To release the jaws it is merely necessary to snap the locking bar 34 out of the notches 44 and swing the locking bar about its pivot line 36 to the unlocked position shown in broken lines, FIGS. 6 and 7.

Figure 9:
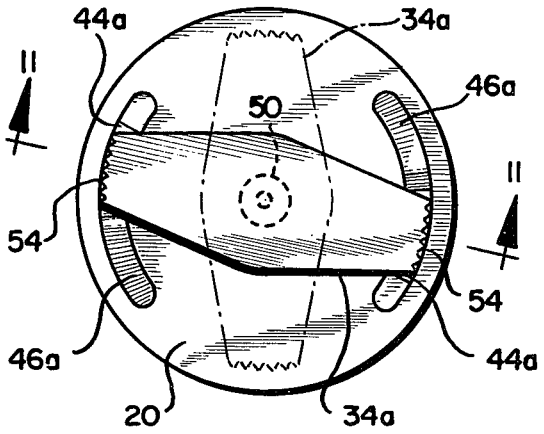
FIG. 9 of a top plan view of a modified form of cap.
Figure 10:
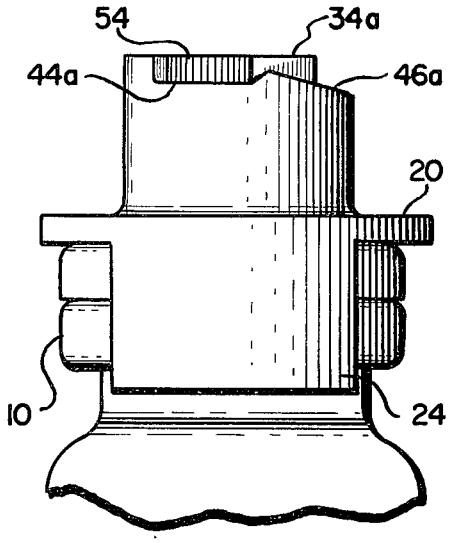
FIG. 10 is an elevational view of the structure of FIG. 9.
Figure 11:
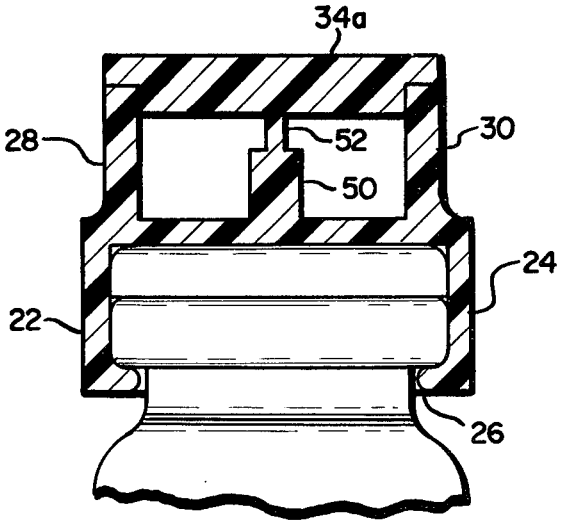
FIG. 11 is a sectional view taken along line 11—11 of FIG. 9.

FIGS. 9–11 show a modified form of the invention in which the locking bar **34*a* is integrally joined to a pivot post 50 that is in turn integral with the base 20 and projects upwardly centrally thereof. The pivot post 50 has a reduced section 52 which is placed torsion within its elastic limits when the locking bar 34*a* is rotated to its locked position. The unlocked position of the locking bar 34*a* is shown in broken lines in FIG. 9. In such conditions the opposed jaws 22, 24 may be spread apart by gripping the flanges 28, 30 as in FIG. 6 so that the jaws clear the vial neck, as previously described. When the locking bar 34*a* is rotated to its locked position, shown in full lines, it rotates about the axis of the pivot connection 52 causing the locking bar 34*a* to ride up on ramps 46*a*, 46*a* of the gripper flanges 28, 30. The locking bar 34*a* is rotated manually until it snaps into notches 44*a*, 44*a* on the flanges 28, 30, thereby locking the bar 34*a* in its locked position. The locking bar 34*a* is tapered from its center toward each end and terminates in knurled ends 54, 54, which facilitate gripping the locking bar 34*a* to remove it from the notches 44*a* to allow the locking bar to rotate back to its unlocked position. At the region where the peripheral parts of the locking bar 34*a* engage the notches 44*a*, the locking bar is substantially as wide as are the notches 44*a*. Consequently, in the locked position of the locking bar 34*a* the gripper flanges 28, 30** are prevented from moving toward each other.

Figure 12:
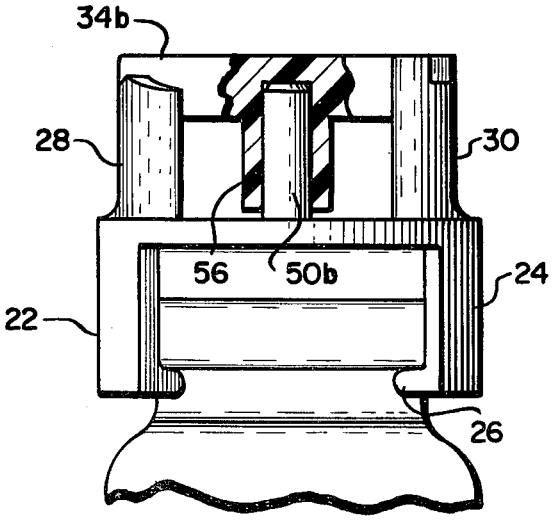
FIG. 12 is an elevational view partially broken away and in section of a further form of the invention.

A further form of the invention is shown in FIG. 12 in which the cap is similar to that shown in FIGS. 9–11 except that the locking bar **34*b* is a separate piece from that of the body of the cap. The body of the cap has an upstanding center post 50*b* which projects into a depending boss 56 centrally of the locking bar 34*b*. The locking bar 34*b* is, therefore, rotatable on post 50*b* between its locked position and its unlocked position. In the locked position the locking bar end portions fit into the notches 44*a* of the gripper flanges 28, 30 in the same manner as shown in FIGS. 9–11**.

Figure 13:
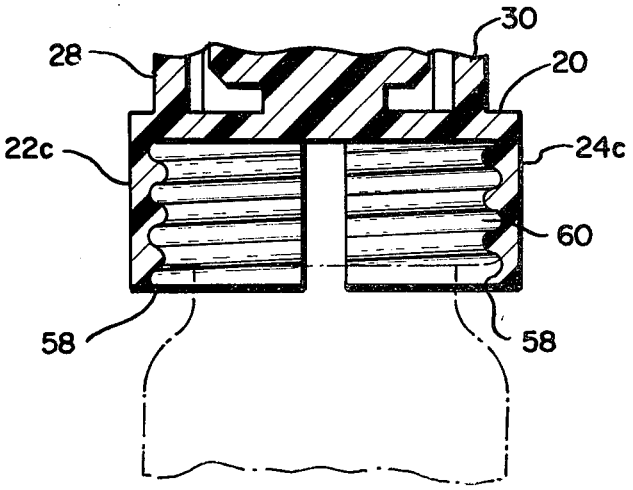
FIG. 13 is a sectional view of another form of the invention.

FIG. 13 shows a further modified form of the invention which is similar to that shown in FIGS. 1–8. However, in this form of the invention each of the jaws **22*c*, 24*c* is formed with internal threads 58, 58 which are adapted to engage companion threads 60 on the exterior of the vial neck 4. This threaded arrangement, while more expensive than the previous embodiments of the inventions, does allow for tightening down of the cap onto the seal closure. Furthermore, by unlocking the locking bar 34 the jaws 22*c*, 24*c*** can be spread apart to provide for a quick release, thereby eliminating the need for unscrewing the cap.

I claim:

1. A reuseable cap for sealing a vial having a neck portion; said cap comprising a body of resilient material having a base for overlying the open end of a vial neck portion, a pair of opposed jaws formed integral with said body and of said resilient material, said pair of jaws projecting from said base in a first direction to extend along said neck portion in radially outward overlying gripping relation with said neck portion, a pair of discrete opposed gripper flanges formed integral with said body and of said resilient material, each said gripper flange projecting in a direction opposite to said first direction, said gripper flanges being diametrically opposed to define an area therebetween, and each being aligned with one of said jaws, such that said gripper flanges may be manually gripped and flexed toward each other thereby to flex said base and spread said jaws in opposition to the resilient forces created in said flexed base tending to bias said jaws toward each other and into engagement with the vial neck portion, and a locking bar member disposed between said gripper flanges and oriented generally transverse thereto, said locking bar member being formed integral with said body and including an integral hinge joining said locking bar to said body for pivotal movement between a first, generally vertical locked position with respect to said body, wherein said locking bar when in said vertical position is disposed between and engaged with said gripper flanges to prevent flexing thereof, and a second, generally horizontal position with respect to said body, wherein said locking bar is disposed out of engagement with the gripper flanges, such that said gripper flanges may be flexed toward each other to spread said jaws preparatory to disengaging said cap from a vial.

2. A cap according to claim 1 in which said gripper flanges have means for retaining said locking bar member in its locked position.

* * * * *